US005884971A

United States Patent [19]

Davis et al.

[11] Patent Number: 5,884,971

[45] Date of Patent: Mar. 23, 1999

[54] BACK REST

[76] Inventors: Shelvie J. Davis; George E. Davis, both of P.O. Box 4413, Greenville, Miss. 38704-4413

[21] Appl. No.: 992,563

[22] Filed: Dec. 17, 1997

[51] Int. Cl.[6] ..... A47C 7/42

[52] U.S. Cl. ..... 297/378.1; 297/352; 297/440.15; 403/67

[58] Field of Search ..... 297/352, 378.1, 297/440.15, 188.04, 411.23, 411.24; 403/67, 102

[56] References Cited

U.S. PATENT DOCUMENTS

| | | | |
|---|---|---|---|
| 570,207 | 10/1896 | Harry | 297/352 X |
| 754,536 | 3/1904 | Billmyer | 297/378.1 X |
| 1,867,799 | 7/1932 | Balmos | 297/378.1 X |
| 2,612,938 | 10/1952 | Dawkins et al. | 297/352 |
| 2,624,394 | 1/1953 | De Milto | 297/352 |
| 4,856,782 | 8/1989 | Cannan | 403/102 X |
| 4,881,776 | 11/1989 | Wang | 297/378.1 |
| 5,326,152 | 7/1994 | Baron | 297/188.04 X |

*Primary Examiner*—Peter R. Brown

[57] ABSTRACT

A releasably mounted back rest is provided including a cushion and a pair of vertical stanchions coupled at top ends thereof to the rear surface of the cushion extended downwardly a predetermined distance. Also included is a joint assembly comprising a pair of lower members hingably coupled to the stanchions. By this structure, the stanchions and lower members of the joint assembly are adapted to pivot between a first orientation wherein the same are linearly aligned and a second orientation wherein the same are situated perpendicular with respect to each other. Lastly, a clamp is situated at bottom ends of the lower members for releasably coupling with a seat.

2 Claims, 2 Drawing Sheets

BACK REST

BACKGROUND OF THE INVENTION

1. Field of the Invention

The present invention relates to back supports and more particularly pertains to a new back rest for releasably attaching to a piano bench, bleacher, stool, or the like.

2. Description of the Prior Art

The use of back supports is known in the prior art. More specifically, back supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art back supports include U.S. Pat. No. 4,611,852; U.S. Pat. No. 4,045,834; U.S. Pat. No. Es. 290,797; U.S. Pat. No. 4,068,889; U.S. Pat. No. 4,475,770; and U.S. Pat. No. Des. 268,976.

In these respects, the back rest according to the present invention substantially departs from the conventional concepts and designs of the prior art, and in so doing provides an apparatus primarily developed for the purpose of releasably attaching a back rest to a piano bench, bleacher, stool, or the like.

SUMMARY OF THE INVENTION

In view of the foregoing disadvantages inherent in the known types of back supports now present in the prior art, the present invention provides a new back rest construction wherein the same can be utilized for releasably attaching to a piano bench, bleacher, stool, or the like.

The general purpose of the present invention, which will be described subsequently in greater detail, is to provide a new back rest apparatus and method which has many of the advantages of the back supports mentioned heretofore and many novel features that result in a new back rest which is not anticipated, rendered obvious, suggested, or even implied by any of the prior art back supports, either alone or in any combination thereof.

To attain this, the present invention generally comprises a stool having a planar top and a plurality of legs coupled to a bottom surface of the planar top and depending downwardly therefrom. The stool further includes a peripheral support defined by a plurality of plates coupled to a bottom surface of the legs and depending downwardly therefrom along a periphery thereof. As shown in FIGS. 1 & 2, a cushion is included having a planar rear surface and an arcuate front surface. A pocket is defined by a square piece of material having a bottom and a pair of side edges attached to the rear surface of the cushion thus defining an interior space and an open top. The pocket further includes a top edge with a strip of elastic attached thereto. Next provided is a pair of vertical stanchions each having a square cross-section. The stanchions are coupled at top ends thereof to the rear surface of the cushion adjacent opposite side edges thereof and extend downwardly a predetermined distance. Coupled to bottom ends of the stanchions is a joint assembly. As best shown in FIGS. 2 & 4, the joint assembly including a pair of lower members each with a square cross-section having a shape and size equal to that of the vertical stanchions. A top end of the lower members have a cut out formed on one of the sides thereof thus defining a block with a cross-section with a size half that of the lower members. The blocks are each adapted to reside within a cut out formed in the bottom end of an associated one of the stanchions. The joint assembly further has a triangular plate having a first side edge each perpendicularly coupled to an associated one of the blocks. As such four triangular plates are included. The triangular plates each have a plurality of coaxial aligned apertures formed in apexes thereof. A single pivot rod is rotatably coupled within each of the apertures. By this structure, the stanchions and lower members of the joint assembly are adapted to pivot between a first orientation wherein the same are linearly aligned and a second orientation wherein the same are situated perpendicular with respect to each other. For allowing the releasable coupling of the back rest to the stool, a pair of clamps are each coupled to a bottom end of the corresponding lower members of the joint assembly. Each clamp has a U-shaped configuration with a threaded aperture formed therein adjacent a free end thereof. A screw is screwably coupled within the threaded aperture. A circular abutment plate is rotatably coupled to a first end of the screw and a disk-shaped knob fixedly coupled to a second end of the screw.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back rest apparatus and method which has many of the advantages of the back supports mentioned heretofore and many novel features that result in a new back rest which is not anticipated, rendered obvious, suggested, or even implied by any of the prior art back supports, either alone or in any combination thereof.

It is another object of the present invention to provide a new back rest which may be easily and efficiently manufactured and marketed.

It is a further object of the present invention to provide a new back rest which is of a durable and reliable construction.

An even further object of the present invention is to provide a new back rest which is susceptible of a low cost of manufacture with regard to both materials and labor, and which accordingly is then susceptible of low prices of sale to the consuming public, thereby making such back rest economically available to the buying public.

Still yet another object of the present invention is to provide a new back rest which provides in the apparatuses and methods of the prior art some of the advantages thereof, while simultaneously overcoming some of the disadvantages normally associated therewith.

Still another object of the present invention is to provide a new back rest for releasably attaching to a piano bench, bleacher, stool, or the like.

Even still another object of the present invention is to provide a new back rest that includes a cushion and a pair of vertical stanchions coupled at top ends thereof to the rear surface of the cushion extended downwardly a predetermined distance. Also included is a joint assembly comprising a pair of lower members hingably coupled to the stanchions. By this structure, the stanchions and lower members of the joint assembly are adapted to pivot between a first orientation wherein the same are linearly aligned and a second orientation wherein the same are situated perpendicular with respect to each other. Lastly, a clamp is situated at bottom ends of the lower members for releasably coupling with a seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
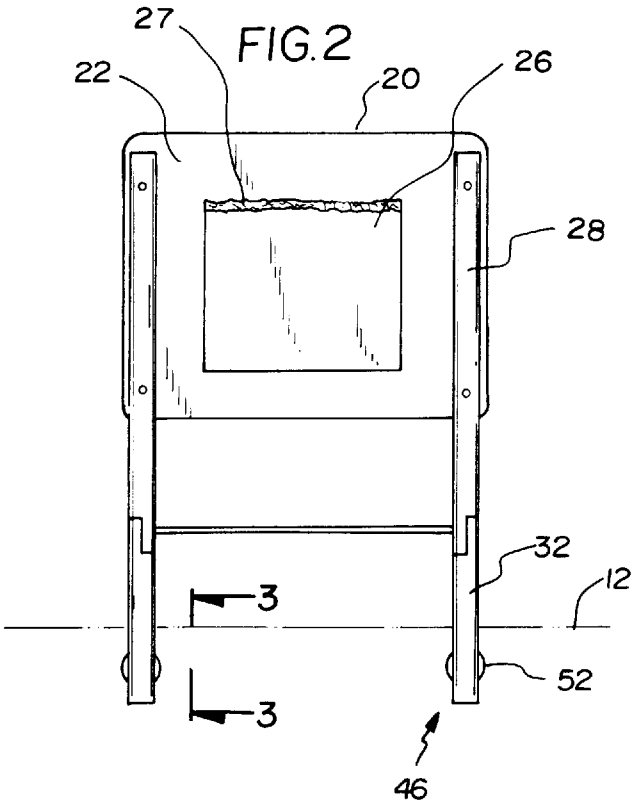
FIG. 2 is a perspective view of the present invention.

With reference now to the drawings, and in particular to FIGS. 1 through 4 thereof, a new back rest embodying the principles and concepts of the present invention and generally designated by the reference numeral 10 will be described.

Figure 1:
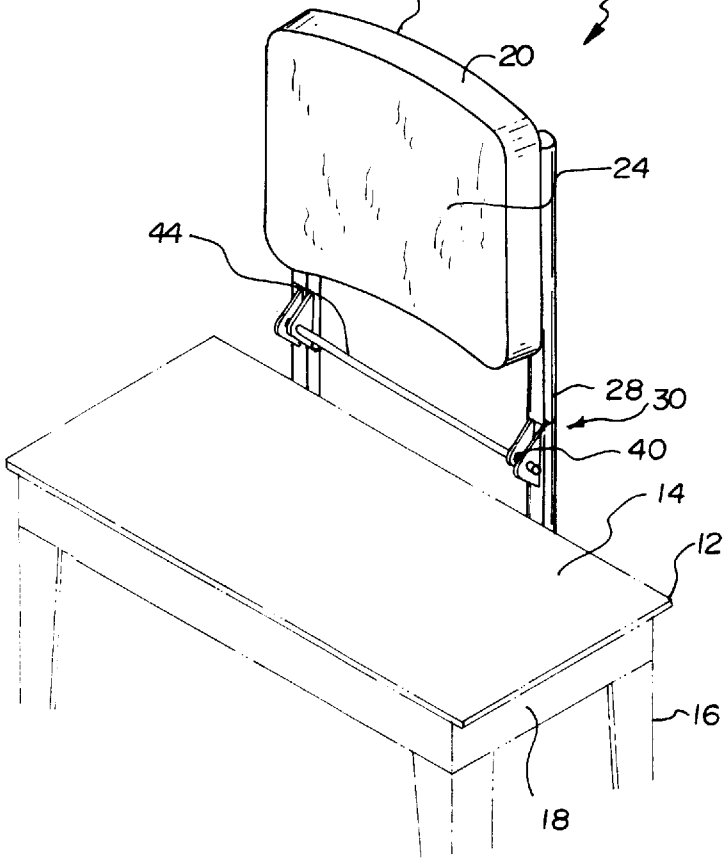
FIG. 1 is an illustration of a new back rest according to the present invention.

The system designated as numeral 10 is adapted for use with a stool 12 having a planar top 14 and a plurality of legs 16 coupled to a bottom surface of the planar top and depending downwardly therefrom. The stool further includes a peripheral support 18 defined by a plurality of rectangular plates coupled to a bottom surface of the legs and depending downwardly therefrom along a periphery thereof. In the alternative, the present invention may be used with a piano bench, bleacher, or the like As shown in FIGS. 1 & 2, a cushion 20 is included having a planar rear surface 22 and an arcuate front surface 24. A pocket 26 is defined by a square piece of material having a bottom and a pair of side edges centrally attached to the rear surface of the cushion thus defining an interior space and an open top. The pocket further includes a top edge with a strip of elastic 27 attached thereto. Preferably, the pocket has a surface area which is greater than half of that of the rear surface of the cushion.

Next provided is a pair of vertical stanchions 28 each having a square cross-section. The stanchions are coupled at top ends thereof to the rear surface of the cushion adjacent opposite side edges thereof and extend downwardly a predetermined distance. As shown in FIG. 2, the stanchions extend along an entire length of the side edges.

Figure 4:
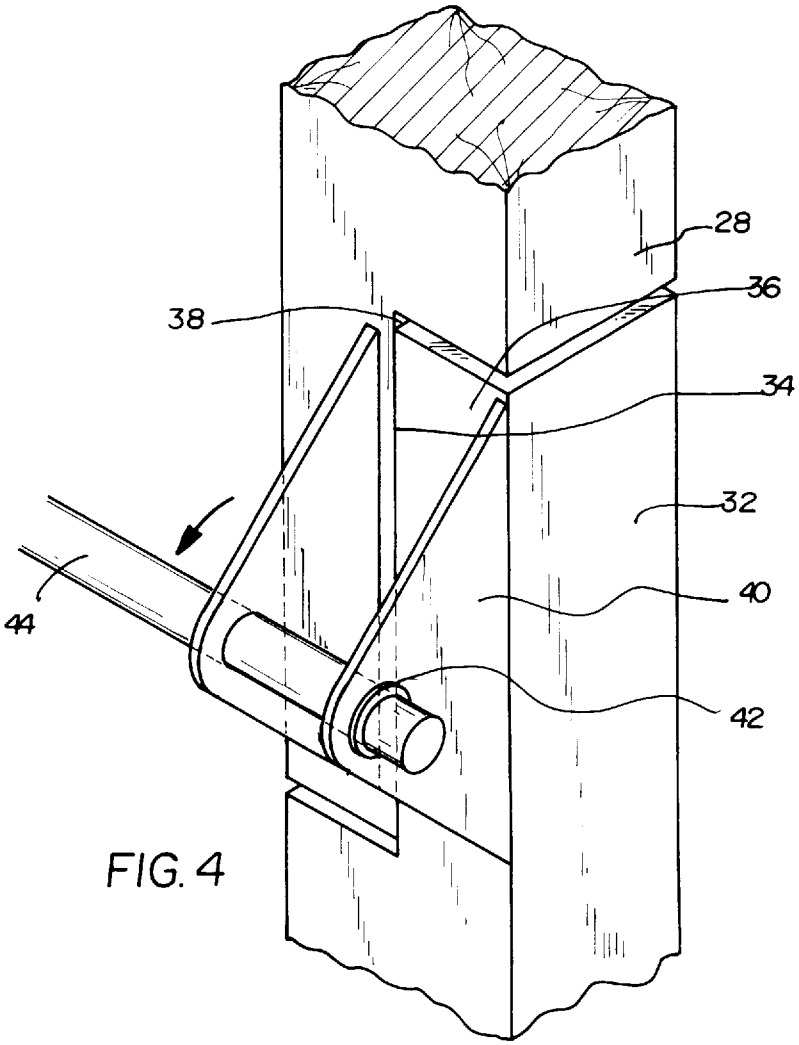
FIG. 4 is a close-up view of the joint assembly of the present invention.
Figure 3:
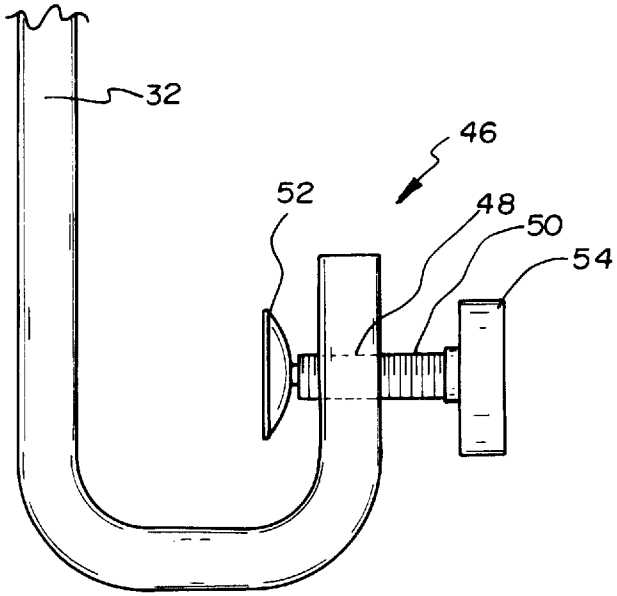
FIG. 3 is a side view of one of the clamps of the present invention.

Coupled to bottom ends of the stanchions is a joint assembly 30. As best shown in FIGS. 2 & 4, the joint assembly including a pair of lower members 32 each with a square cross-section having a shape and size equal to that of the vertical stanchions. A top end of the lower members each have a cut out 34 formed on an interior side thereof thus defining a block 36 with a cross-section having a size which is half that of the lower members. The blocks are each adapted to reside within a cut out 38 formed in the bottom end of an associated one of the stanchions. It should be noted that the blocks defined by the cut outs of the lower members are similar in size and shape to those of the stanchions.

The joint assembly further has a plurality of triangular plates 40 each having a first side edge perpendicularly coupled to an associated one of the blocks. As such, four triangular plates are included. As shown in the Figures, the triangular plates are positioned on the same side of the stanchions as the cushion. The triangular plates each have a plurality of coaxial aligned apertures 42 formed in apexes thereof. A single pivot rod 44 is rotatably coupled within each of the apertures.

By this structure, the stanchions and lower members of the joint assembly are adapted to pivot between a first orientation wherein the same are linearly aligned and the cushion resides within a vertical plane. The lower members and joint assembly are further adapted to pivot to a second orientation. In the second orientation, the stanchions and lower members are situated perpendicular with respect to each other and the cushion sits on the top of the stool. While not shown, a pair of stoppers extend upwardly from a top rear surface of the block of each lower member for preventing the over rearward rotation of the stanchions. As an option, the pivot rod may be equipped with a locking mechanism for maintaining the stanchions and lower members in the first orientation.

For allowing the releasable coupling of the back rest to the stool, a pair of clamps 46 are each coupled to a bottom end of the corresponding lower members of the joint assembly. Each clamp has a U-shaped configuration with one of the vertical members thereof integrally coupled to the corresponding lower member of the joint assembly. In the alternative, the members of the U-shaped clamps may be coupled perpendicularly with respect to the lower members for allowing the coupling thereof with a horizontal surface.

Each clamp further has a threaded aperture 48 formed therein adjacent a free end thereof. A screw 50 is screwably coupled within the threaded aperture. A circular abutment plate 52 is rotatably coupled to a first end of the screw and a disk-shaped knob 54 is fixedly coupled to a second end of the screw. While not shown, the knob has a plurality of undulations formed about its periphery. In use, the U-shaped clamps may be situated on the peripheral support of the stool and the knob rotated for constraining the peripheral support between the abutting plate and the lower members.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A releasably mounted back rest comprising, in combination:

a stool with a planar top and a plurality of legs coupled to a bottom surface of the planar top and depending downwardly therefrom, the stool further including a peripheral support including a plurality of plates coupled to the bottom surface and depending downwardly therefrom along a periphery thereof;

a square cushion having a planar rear surface and an arcuate front surface;

a pocket defined by a square piece of material having a bottom and a pair of side edges attached to the rear surface of the cushion thus defining an interior space and an open top, the pocket further having a top edge with a strip of elastic attached thereto;

a pair of vertical stanchions each having a square cross-section and coupled at top ends thereof to the rear surface of the cushion adjacent opposite side edges thereof and extending downwardly a predetermined distance;

a joint assembly coupled to bottom ends of the stanchions, the joint assembly including a pair of lower members each with a square cross-section having a shape and size equal to that of the vertical stanchions with a top end having a cut out formed on one of the sides thereof thus defining a block with a cross-section with a size half that of the lower members, the blocks each adapted to reside within a cut out formed in the bottom end of an associated one of the stanchions wherein the cut outs of the stanchions define blocks, the blocks of the lower members and the stanchions totaling four, the joint assembly including a triangular plate having a first side edge each perpendicularly coupled to an associated one of the blocks such that a triangular plate extends from each of the blocks, the triangular plates having a plurality of coaxial aligned apertures formed in apexes thereof, the joint assembly further including a single pivot rod rotatably coupled within each of the apertures to define a pivot axis, whereby the stanchions and lower members of the joint assembly are adapted to pivot between a first orientation wherein the stanchions and lower members are linearly aligned and a second orientation wherein the stanchions and lower members are situated perpendicular with respect to each other; and a pair of clamps each coupled to a bottom end of the corresponding lower members of the joint assembly for releasably coupling with the stool, each clamp having a U-shaped configuration with a threaded aperture formed therein adjacent a free end thereof, a screw screwably coupled within the threaded aperture, a circular abutment plate rotatably coupled to a first end of the screw and a disk-shaped knob fixedly coupled to a second end of the screw.

2. A releasably mounted back rest for use with a stool having a substantially planar top and a plurality of legs coupled to a bottom surface of the planar top and depending downwardly therefrom, the back rest comprising:

a cushion having a substantially planar rear surface and a front surface;

a pocket defined by a piece of material having edges attached to the rear surface of the cushion thus defining an interior space and an open top, the pocket further having a top edge with a strip of elastic attached thereto;

a pair of vertical stanchions coupled at top ends thereof to the rear surface of the cushion adjacent opposite side edges thereof and extending downwardly a predetermined distance;

a joint assembly coupled to bottom ends of the stanchions, the joint assembly including a pair of lower members each with a top end having a cut out formed on one of the sides thereof thus defining a block, the blocks each adapted to reside within a cut out formed in the bottom end of an associated one of the stanchions wherein the cut outs of the stanchions define blocks, the blocks of the lower members and the stanchions totaling four, the joint assembly including a support plate having a first side edge each coupled to an associated one of the blocks such that a support plate extends from each of the blocks, the support plates having a plurality of coaxial aligned apertures formed therein, the joint assembly further including a pivot rod rotatably coupled within each of the apertures to define a pivot axis, whereby the stanchions and lower members of the joint assembly are adapted to pivot between a first orientation wherein the stanchions and lower members are linearly aligned and a second orientation wherein the stanchions and lower members are situated perpendicular with respect to each other; and a pair of clamps each coupled to a bottom end of the corresponding lower members of the joint assembly and adapted for releasably coupling with the stool, each clamp having a substantially U-shaped configuration with a threaded aperture formed therein adjacent a free end thereof, a screw screwably coupled within the threaded aperture, an abutment plate rotatably coupled to a first end of the screw and a knob fixedly coupled to a second end of the screw.

* * * * *